United States Patent [19]

Sands

[11] 4,113,259

[45] Sep. 12, 1978

[54] BOARD GAME APPARATUS WITH WATER EJECTING DEVICE

[76] Inventor: Terry Michael Sands, 16 Ash, Belleville, Mich. 48111

[21] Appl. No.: 745,614

[22] Filed: Nov. 29, 1976

[51] Int. Cl.[2] ..... A63F 3/00

[52] U.S. Cl. ..... 273/241; 273/249; 273/287

[58] Field of Search ..... 273/134

[56] References Cited

U.S. PATENT DOCUMENTS

| | | | |
|---|---|---|---|
| 1,389,162 | 8/1921 | Reed | 273/134 AT UX |
| 1,559,954 | 11/1925 | Gifford | 273/134 B |
| 3,659,852 | 5/1972 | Redict | 273/134 AT UX |
| 3,734,508 | 5/1973 | Snyder | 273/134 AT UX |

*Primary Examiner*—Anton O. Oechsle
*Attorney, Agent, or Firm*—Irving M. Weiner

[57] ABSTRACT

A game apparatus including a game playing surface disposed on a casing. The center of the game playing surface is provided with a water ejection device which is operable by a valve member to eject water therefrom onto the players as part of the game. The playing surface has a peripheral path of game playing spaces thereon, and players employ playing tokens which are moved along the path of game playing spaces.

9 Claims, 6 Drawing Figures

FIG. 1
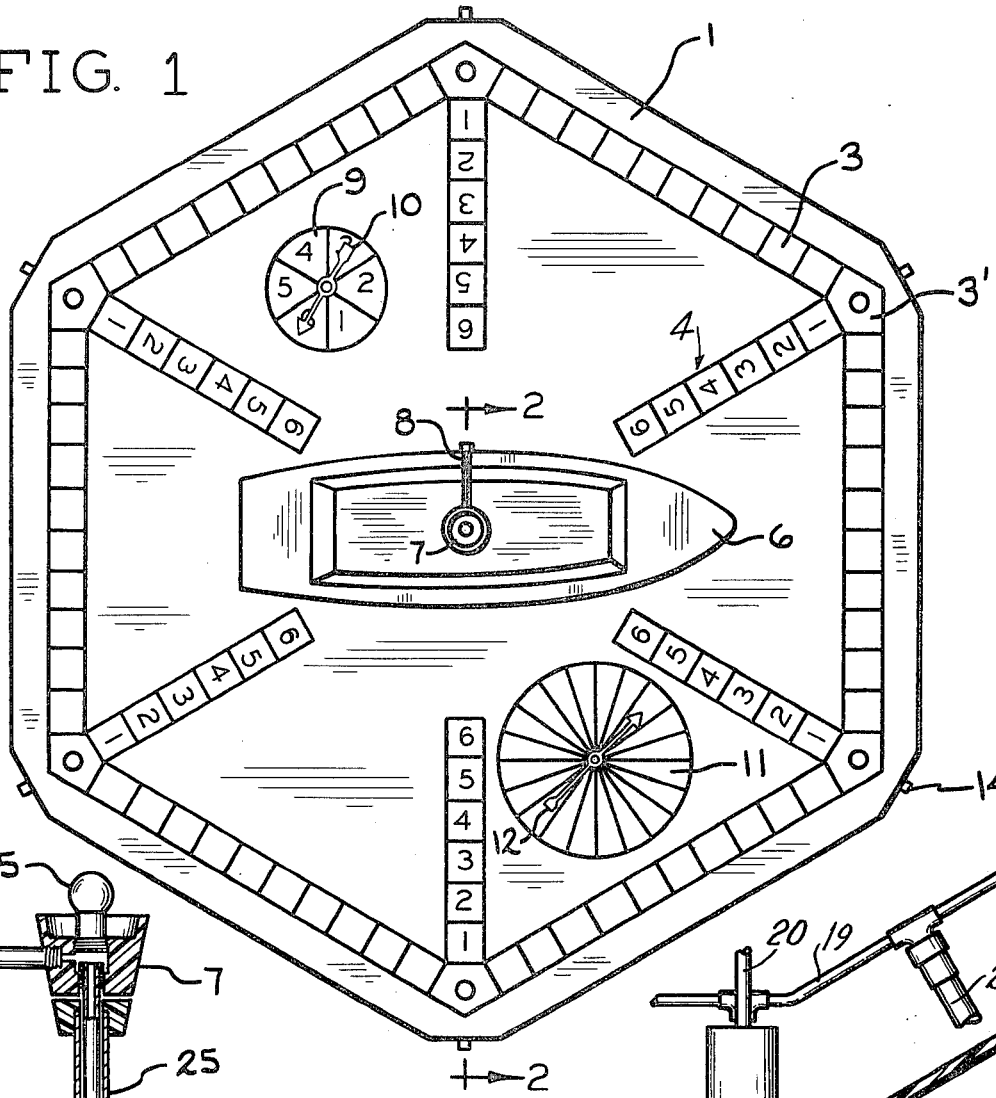
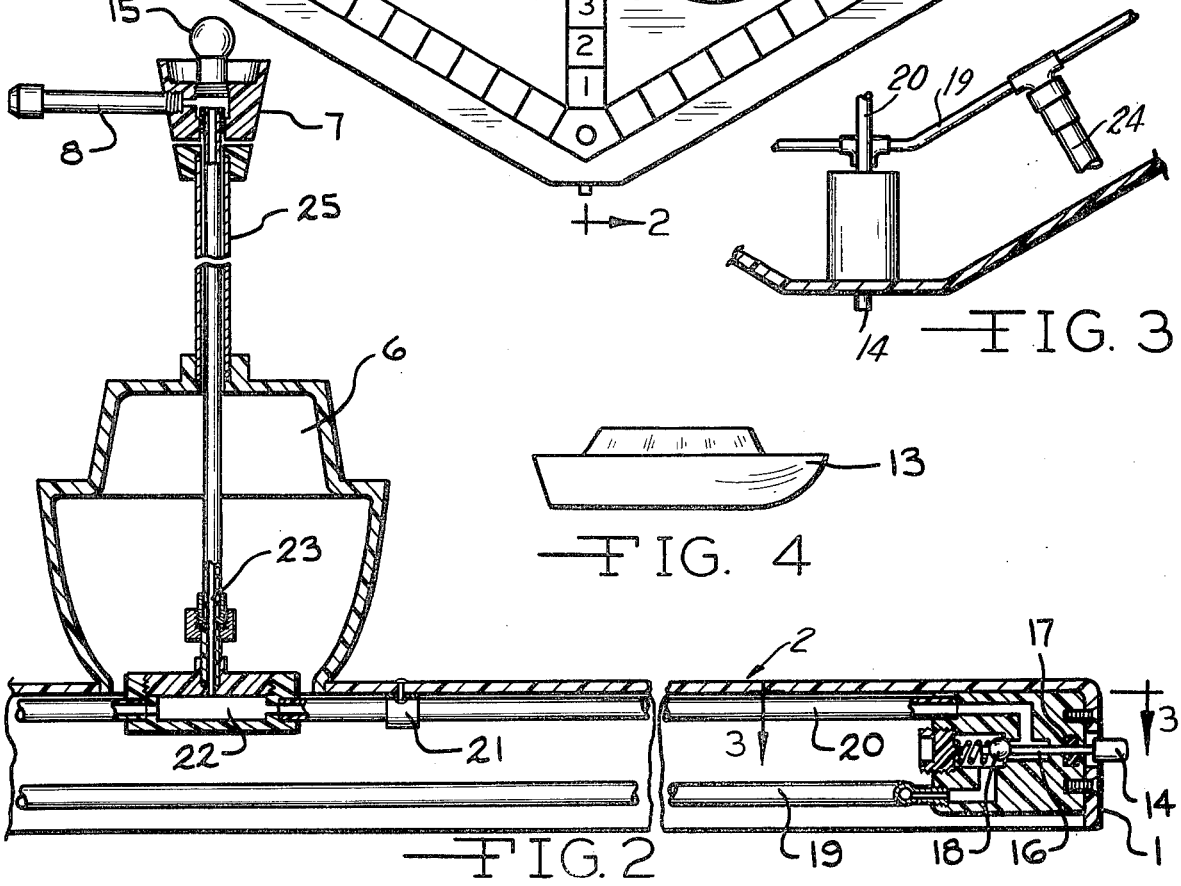
FIG. 2
FIG. 3
FIG. 4

BOARD GAME APPARATUS WITH WATER EJECTING DEVICE

BACKGROUND OF THE INVENTION

1. Field of the Invention

The present invention relates generally to a game apparatus including a game playing surface having a water ejection device disposed at the center thereof, and methods of constructing and utilizing same.

In particular, the present invention relates to a game apparatus employing a game playing surface having provided thereon a continuous peripheral path divided into playing spaces. Players employ playing tokens which are moved along the path of playing spaces to an ultimate win position. The water ejection device is used during the course of the game and is triggered by a valve member operable by the players.

2. Description of the Prior Art

In present times, with a great deal of leisure time being at the disposal of most individuals and especially children, there has developed a need for game apparatus which are entertaining, thrilling and unusual. Although a host of prior art games are available, most of such games are quite mundane, and incapable of providing unusual and exciting entertainment.

Illustrative of prior art game apparatus is the "ELECTRIC PICKLE JAR GAME" disclosed in U.S. Pat. No. 3,547,436 issued in 1970 to Breslow; the "BOARD GAME APPARATUS" disclosed in U.S. Pat. No. 3,759,522 issued in 1973 to Hodan III; the "BOARD GAME APPARATUS" disclosed in U.S. Pat. No. 3,817,531 issued in 1974 to King et al.; and the "CHANCE CONTROLLED MATCHING GAME" disclosed in U.S. Pat. No. 3,948,525 issued in 1976 to Faintuch et al.

The present invention eliminates the disadvantages and shortcomings of the conventional prior art game apparatus by providing a game apparatus which includes a water ejection device which provides for unusual, refreshing, and exciting game entertainment which is especially appealing to children, but also appealing to adults.

SUMMARY OF THE INVENTION

The present invention provides a game apparatus which includes a casing having disposed adjacent the top portion thereof a substantially flat game playing surface having a continuous peripheral path, with the path being divided into playing spaces. First means for ejecting water is operatively and rotatably connected to the game playing surface at the center of the game playing surface. Second means for supplying water to the first means is disposed within the casing, and at least one switch mechanism is disposed in the casing adjacent the game playing surface and operatively connected to the first means to permit a player to eject water from the first means. At least one movable playing token is associated with each player for indicating the position of the player on the path, and third means are provided for randomly selecting the number of playing spaces that each of the tokens should be moved along the path during a player's turn.

In accordance with a preferred embodiment of the present invention, a substantial number of the playing spaces have disposed thereon game move instructions, and the game playing surface is hexagonal in configuration. Each corner space of the peripheral path of the hexagonal game playing surface defines a player game start position. A game winning position indicator is disposed at the center of the game playing surface, with the first means disposed thereon. A row of six playing spaces extends from each of the corner playing spaces on the peripheral path into close proximity with the center of the game playing surface.

It is an object of the invention to provide a game apparatus which includes a water ejection device for ejecting water onto the players of the game to provide a refreshing and entertaining game.

Other objects and details of the invention will become apparent from the following description, when read in conjunction with the accompanying drawings.

BRIEF DESCRIPTION OF THE DRAWINGS

FIG. 1 illustrates a top plan view of the game playing surface in accordance with the invention.

FIG. 2 depicts a view of the game apparatus taken along line 2—2 of FIG. 1.

FIG. 3 shows a view of the game apparatus taken along line 3—3 of FIG. 2.

FIG. 4 illustrates a preferred embodiment of the player tokens for use on the game playing surface.

DETAILED DESCRIPTION OF SOME PREFERRED EMBODIMENTS OF THE PRESENT INVENTION

Figure 5:
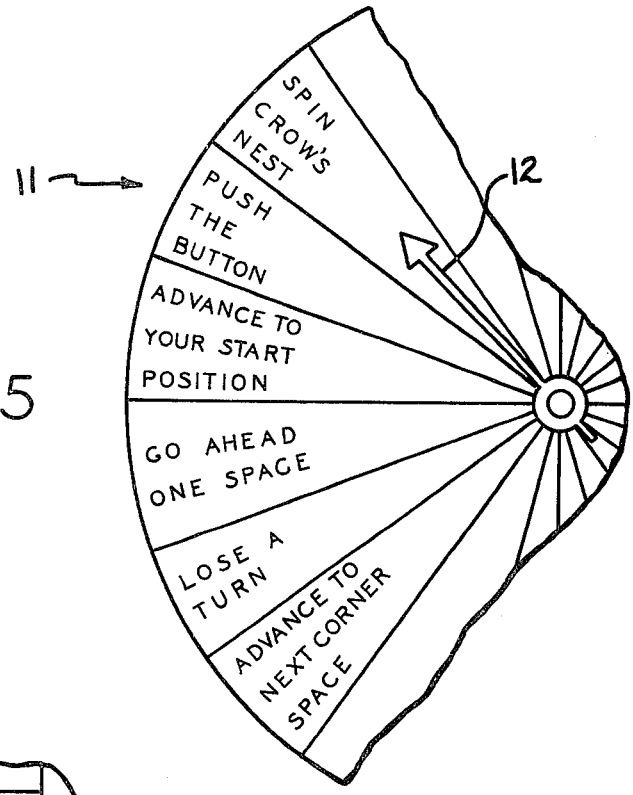
FIG. 5 depicts a portion of a dial face member in accordance with the invention.

With reference to FIG. 1, the game apparatus including the casing 1 and the game playing surface 2 disposed adjacent the top portion of the casing 1 is illustrated. In the preferred embodiment illustrated in FIG. 1, the game playing surface 2 is hexagonal in shape; however, it should be noted that any other polygonal or circular shape may be employed for the game playing surface 2. Along the periphery of the playing surface 2 is disposed a path divided into game playing spaces 3. In addition, a row of playing spaces 4 extends inwardly from each corner space 3' into close proximity with the center of the playing surface 2. At the center of the playing surface 2 is disposed a toy boat 6 which serves as a game winning position indicator as will be discussed more thoroughly hereinbelow.

Positioned at the top of the boat 6 is a water ejection device 7 with a squirting nozzle 8. The functioning of the device 7 will be described more thoroughly hereinbelow with reference to FIG. 2.

Also disposed on the playing surface 2 is a dial face member 9 divided into six numbered segments and having a spinning pointer 10 disposed thereon. A second dial face member 11 having twenty divisions, and a spinning pointer 12 disposed thereon is also positioned on the playing surface 2.

Each player is provided with a playing token 13 (FIG. 4) which is used to indicate the position of each player on the path of playing spaces 3. Although the token as depicted in FIG. 4 is illustrated as a miniature boat, it should be noted that any other desired configuration for the tokens can be employed.

Positioned on the casing 1 in close proximity to each of the corner spaces 3' of the playing surface 2 are push buttons 14 which serve to cause water to be ejected from squirting nozzle 8 as will be described hereinbelow.

Referring now to FIG. 2, it can be seen that when the push button 14 is pushed, the shaft 16 connected thereto (sealed by "O" ring 17) will unseat the valve member or ball 18 from its spring-held sealing position. This will permit water supplied from main supply tube 19 (discussed more thoroughly hereinbelow with respect to FIG. 3) to flow into tube 20 which is clamped to the casing 1 by means of a clamp 21. The water will flow into manifold 22, up through tube 23, and eventually will be ejected outwardly through squirting nozzle 8. Each of the push buttons 14 is connected in a like manner, as depicted in FIG. 2, to the manifold 22, so as to provide each player with push-button control of the water ejection device 7.

The water ejection device 7 is rotatably disposed on the tube housing 25 which has tube 23 disposed therein. The knob 15 is secured to device 7 so as to permit rotation of the device 7 around the axis of tube housing 25 when the knob 15 is turned by a player.

With reference to FIG. 3, it can be seen that water is supplied to the system of FIG. 2 by means of an ordinary garden hose 24 which is coupled to the main supply tube 19. The water pressure supplied to main supply tube 19 can be adjusted by a standard garden hose adjustment valve. The garden hose 24 is fed by a house water outlet (not shown). Each of the components included in the water supply system disclosed in FIGS. 2 and 3, including the valves, manifold, seals, etc., are well known, and thus will not be described in great detail herein.

In the preferred embodiment of the invention, it is desirable that the water ejection device 7 comprise a "crow's nest" for the boat 6; the rows of playing spaces 4 serve as "planks" leading to the boat 6; and the remaining area of the playing surface 2 enclosed by the path of playing spaces 3 serves as a body of water surrounding the boat 6 labelled, for example, "HARBOR".

Figure 6:
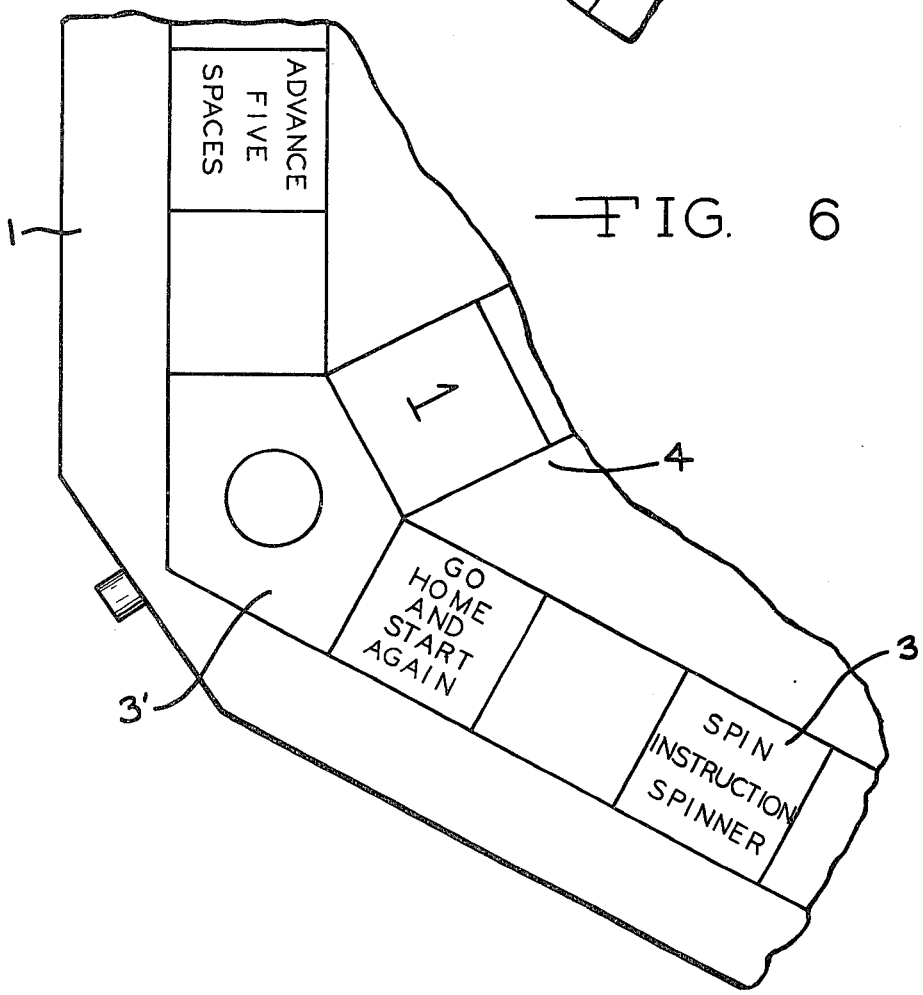
FIG. 6 illustrates a portion of a path of playing spaces on the game playing surface.

In playing the game, each player has his associated token 13 positioned on his designated corner space 3'. Thus, the corner spaces 3' serve as the game start positions for the players. With the hexagonal playing surface 2 of FIG. 1, any number of players up to and including six can play in a single game. A substantial number of the playing spaces 3 are labelled with specific game move instructions as shown in part in FIG. 6, such as, for example, "GO BACK THREE SPACES"; "SPIN INSTRUCTION SPINNER"; "ADVANCE FIVE SPACES"; "TAKE SOMEONE OFF THEIR SPACE AND SEND THEM BACK HOME"; and "GO HOME AND START AGAIN". To progress the tokens 13 around the spaces 3, the players take turns spinning the spinning pointer 10 to determine the number of spaces to be advanced. For example, if the spinning pointer 10 comes to rest pointing at the segment numbered "6" as shown in FIG. 1, the player will advance his token 13 over six of the spaces 3. Then, if the particular space 3 upon which he lands contains a game move instruction, such as "GO BACK THREE SPACES", he will move back three spaces, and so on. If the player lands on one of the spaces 3 marked "SPIN INSTRUCTION SPINNER", he will spin the spinning pointer 12 to obtain additional game move instructions. The twenty divisions of dial face member 11 contain instructions as shown in part in FIG. 5, such as, for example, "SPIN CROW'S NEST, PUSH THE BUTTON"; "ADVANCE TO YOUR START POSITION"; "GO AHEAD ONE SPACE"; "LOSE A TURN"; "ADVANCE TO NEXT CORNER SPACE"; etc. It should be noted that the dial face 11 and spinning pointer 12 can be replaced, if desired, by plastic cards marked with the game move instructions exemplified above. Also, the dial face 9 and spinning pointer 10, if desired, can be replaced by a conventional numbered die. The game will continue, with each player advancing around the path of playing spaces 3, until each player returns back into close proximity with his original starting position corner 3'. At this point, each of the players must obtain a designated number when spinning the spinning pointer 10 in order to advance his token to his own original start space 3'. Next, the player must again obtain his designated number with the spinning pointer 10 before advancing to that number on the row of playing spaces 4 or the "plank" which leads to the boat 6. In this connection, it can be seen that the number of playing spaces in the row of playing spaces 4 corresponds to the number of corner spaces 3', and thus each player can be assigned his own individual designated number which will permit him to reenter his own start space 3' and then enter the plank 4 as above described. Thus, if for example the game playing surface 2 was square, there would be four corner spaces 3' and four rows of playing spaces 4 making up each of the "planks" leading to the center of the game playing surface 2.

Upon entering his designated number space on the plank or row of spaces 4, the player is permitted to "SPIN" the crow's nest 7 by rotating same to face a selected player and push his button 14 to squirt the selected player via nozzle 8. Finally, the game is won when one of the players advances along his particular plank or row of spaces 4 to the boat 6. Hereagain, before advancing to the boat 6 each player must again obtain his own designated number with the spinning pointer 10.

It should be noted that the particular game instructions set forth hereinabove are merely exemplary of the wide variety and arrangement of instructions which can be employed with the present invention. The prime object of the invention is that the water ejected through nozzle 8 serves to refresh and excite the players, especially in extremely warm weather when played outdoors, and any variation of the rules for use with the game which permits alternatively squirting one's self or one's opponents with water may be employed and is contemplated herein.

It is highly desirable that the material used in fabricating the game apparatus be impervious to water, such as plastic, polyethylene, and/or polystyrene, etc. In addition, it is also desirable that the casing having the game playing surface 2 disposed thereon be flexible so as to permit the game apparatus to adapt to uneven surfaces as might be found outdoors.

The present invention may be embodied in other specific forms without departing from the spirit or essential characteristics thereof. The present embodiments are therefore to be considered in all respects as illustrative, and not restrictive. The scope of the invention is indicated by the appended claims rather than by the foregoing description.

I claim:

1. A competitive game apparatus, comprising:

a casing having disposed adjacent the top portion thereof a substantially flat game playing surface having a continuous peripheral path, said path being divided into playing spaces;

first means for ejecting water, said first means being operatively and rotatably connected to said game playing surface and disposed at the center of said game playing surface in a position to permit the ejected water to be directed toward a selected player;

second means for supplying water to said first means, said second means being disposed within said casing;

at least one switch mechanism disposed in said casing adjacent said game playing surface and operatively connected to said first means for permitting a player to eject water from said first means;

at least one movable playing token associated with each player for indicating the position of the player on said path; and third means for randomly selecting the number of playing spaces that each of said tokens should be moved along said path.

2. A competitive game apparatus in accordance with claim 1, wherein:

a substantial number of said playing spaces have disposed thereon game move instructions;

said game playing surface is polygonally shaped; and each corner space of said peripheral path of said polygonal game playing surface defines a player game start position.

3. A competitive game apparatus in accordance with claim 2, wherein:

said switch mechanism comprises a push-button for permitting a player to eject water from said first means;

one of said push buttons is disposed adjacent each corner space of said path; and said third means comprises a dial face member divided into a plurality of numbered segments and having rotatably disposed thereon a spinning pointer which when spun by a player randomly selects one of said numbered segments to indicate the number of playing spaces that the player's token should be moved along said path.

4. A competitive game apparatus in accordance with claim 2, wherein:

a game winning position indicator is disposed at the center of said game playing surface;

said first means is disposed on top of said game winning position indicator; and a row of playing spaces extends from each of said corner playing spaces on said peripheral path into close proximity with said game winning position indicator.

5. A competitive game apparatus in accordance with claim 4, wherein:

said game winning position indicator comprises a toy boat; and said movable playing tokens are in the form of miniature boats.

6. A competitive game apparatus in accordance with claim 2, wherein:

fourth means are provided for randomly selecting a particular game move instruction; and at least one of said game move instructions displayed on said playing spaces instructs a player to utilize said fourth means.

7. A competitive game apparatus in accordance with claim 6, wherein:

said fourth means comprises a dial face member divided into a plurality of segments, each segment having disposed thereon a particular game move instruction, and a spinning pointer rotatably disposed on said dial member to randomly select one of said segments when said pointer is spun by a player; and said third means comprises at least one standard die.

8. A competitive game apparatus in accordance with claim 2, wherein:

said second means for supplying water includes a standard garden hose adapted to be connected to a house water outlet; and said game apparatus is fabricated of material which is impervious to water.

9. A competitive game apparatus in accordance with claim 2, wherein:

said polygonal game playing surface is hexagonal in configuration;

said peripheral path is divided into an equal number of playing spaces between the corners thereof;

each of the six corner spaces of said peripheral path defines a player game start position;

a row of six playing spaces extends from each of said corner playing spaces on said peripheral path into close proximity with the center of said game playing surface;

a game winning position indicator is disposed at the center of said game playing surface; and said game apparatus is fabricated of material which is impervious to water.

* * * * *